US009693646B2

(12) United States Patent
Brill

(10) Patent No.: US 9,693,646 B2
(45) Date of Patent: Jul. 4, 2017

(54) SHADOW PROJECTING DEVICE

(76) Inventor: Donnie Leo Brill, Urbandale, IA (US)

( * ) Notice: Subject to any disclaimer, the term of this patent is extended or adjusted under 35 U.S.C. 154(b) by 856 days.

(21) Appl. No.: 13/359,780

(22) Filed: Jan. 27, 2012

(65) Prior Publication Data

US 2013/0194785 A1 Aug. 1, 2013

(51) Int. Cl.

| | |
|---|---|
| ***A47G 33/02*** | (2006.01) |
| ***F21S 10/00*** | (2006.01) |
| ***F21V 33/00*** | (2006.01) |
| ***A47G 33/00*** | (2006.01) |

(52) U.S. Cl.

CPC ..... *A47G 33/00* (2013.01); *A47G 33/02* (2013.01); *F21S 10/00* (2013.01); *F21V 33/00* (2013.01)

(58) Field of Classification Search

CPC ..... A47G 33/02; F21S 6/005–6/008; F21S 10/00; F21V 33/0024–33/0056

USPC ..... 362/125

See application file for complete search history.

(56) References Cited

U.S. PATENT DOCUMENTS

| | | | | |
|---|---|---|---|---|
| 2,506,295 | A * | 5/1950 | Elvan | A47G 33/02 362/124 |
| 3,992,812 | A * | 11/1976 | Horowitz | A01G 17/04 428/3 |
| 5,582,883 | A * | 12/1996 | Keshishian | A47G 33/02 206/19 |
| 7,393,116 | B1 * | 7/2008 | Holmes | F21S 2/00 362/122 |
| 7,625,095 | B1 * | 12/2009 | Ohs | 362/125 |
| 8,453,379 | B1 * | 6/2013 | Kumar | A01G 9/02 47/39 |

* cited by examiner

*Primary Examiner* — Mariceli Santiago

(74) *Attorney, Agent, or Firm* — McKee, Voorhees & Sease, PLC

(57) ABSTRACT

A shadow projecting device includes a box which acts as a base. A four sided cavity is formed within the box. Sand is provided and retained within the cavity. Crosses extend upwardly through the sand above the box. Stones may be provided on the sand. A light source is provided at the front of the box. The light is directed rearward and upward to illuminate the crosses and create a shadow on a wall behind the box. The size of the shadow on the wall varies according the distance of the box from the wall.

12 Claims, 8 Drawing Sheets

SHADOW PROJECTING DEVICE

FIELD OF THE INVENTION

The present invention relates generally to devices for projecting shadows and devices for storing books. More particularly, the invention relates to a device for projecting shadows in the shape of a cross and for storing a Bible.

BACKGROUND OF THE INVENTION

People often desire mechanisms for sharing their faith and displaying personal reminders of their faith. The cross is an especially important symbol to people of the Christian faith. Displays of the cross can serve as a mechanism for Christians to share their faith and provide a personal reminder of their faith. It can also be desirable to store a Bible in a special or commemorative storage space.

SUMMARY OF THE INVENTION

According to one embodiment the present invention is directed to a shadow projecting device that includes an upper receptacle. The upper receptacle has a cavity defined by a front wall, rear wall, side walls, and a bottom wall. Sand is retained within the cavity of the upper receptacle. A first vertical projection extends upwardly from the bottom wall through the sand to a height above the rear wall. A light source is associated with the front wall. A background surface is spaced rearwardly from the rear wall. A light source shines light rays generally upwardly and rearwardly towards the first vertical projection to form a shadow having a shape of the first vertical projection on the background. The first vertical projection may be in the shape of a cross. Second and third vertical projections, each having the shape of a cross, may also be provided that extend upwardly from the bottom wall. A horizontal shelf may be provided below the bottom wall and supported by the front, back and side walls, wherein the front wall has an open space above the shelf. A book may be supported on the shelf. The book may be a Bible. A drawer that opens through the front wall may also be provided below the bottom wall.

DETAILED DESCRIPTION OF THE PREFERRED EMBODIMENTS

Figure 1A:
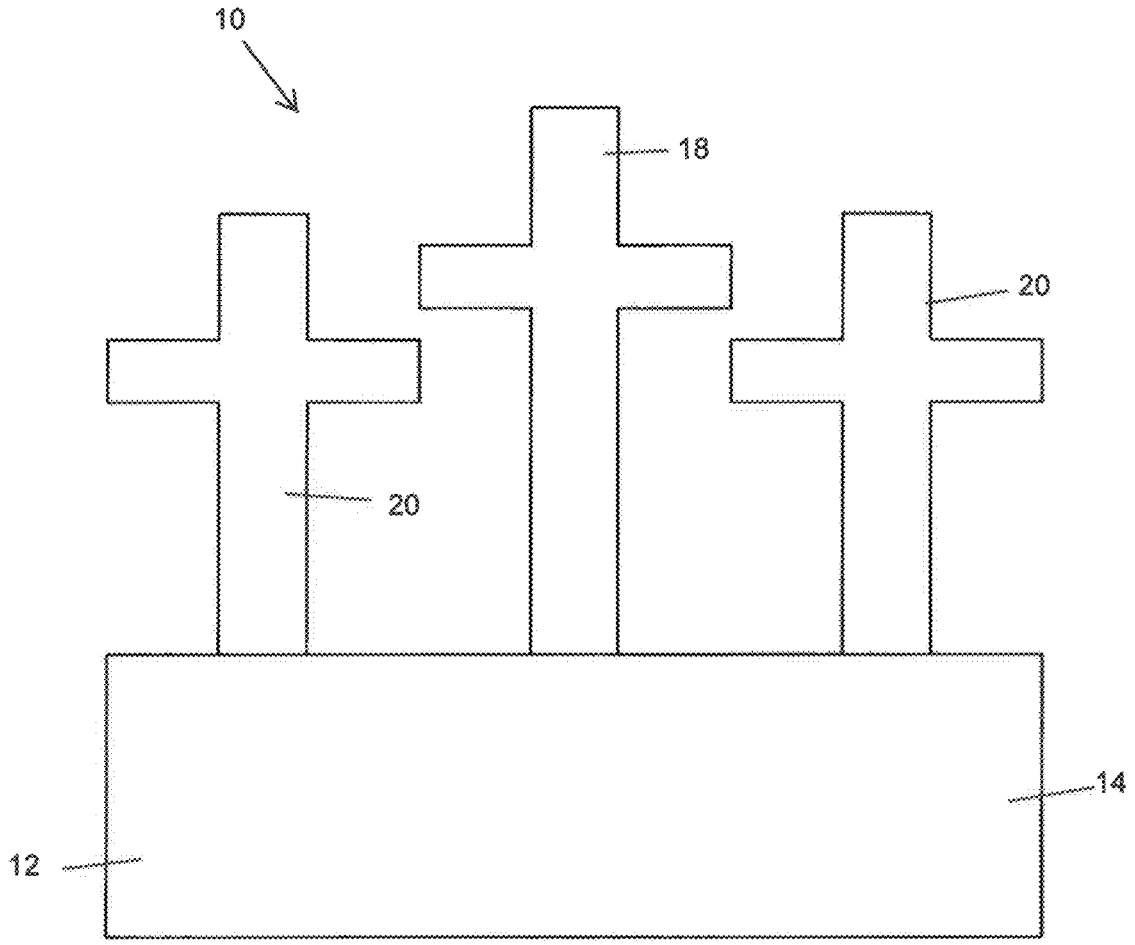
FIG. 1A is a front elevation view of a shadow projecting device according to one embodiment of the present invention.
Figure 1B:
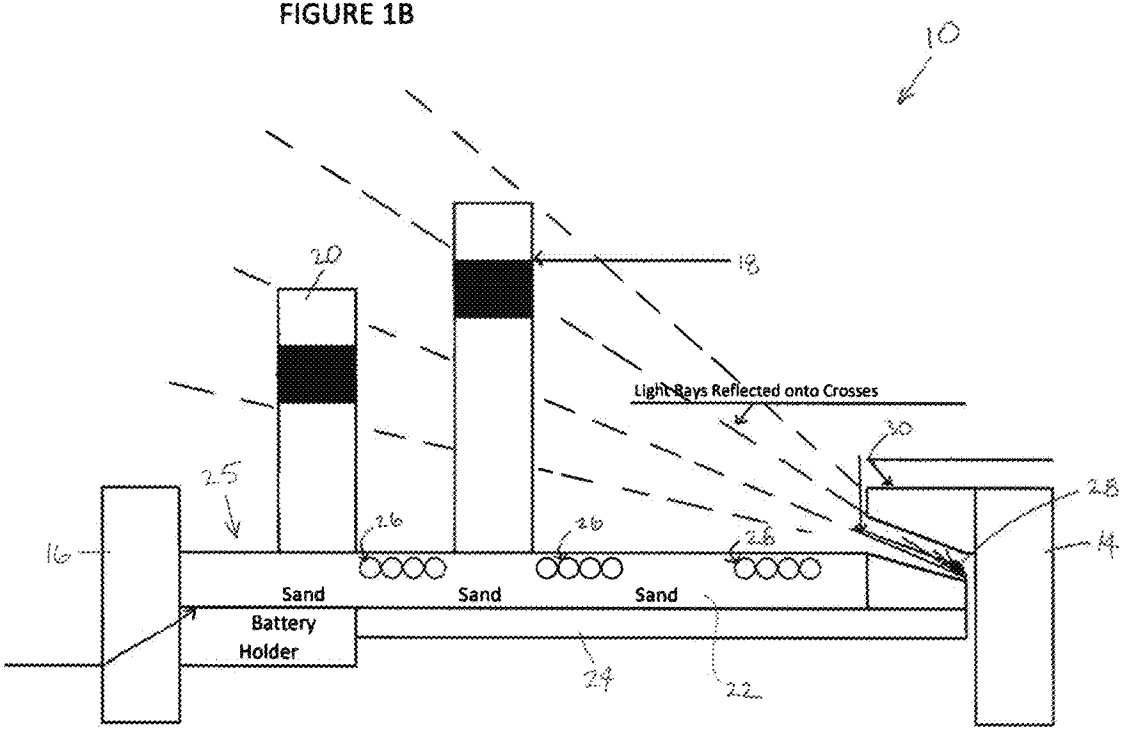
FIG. 1B is a cross sectional side elevation view of the shadow projecting device of FIG. 1A.

FIGS. 1A and 1B show a shadow projecting device 10 according to one embodiment of the present invention. The device 10 has a base formed by a box 12. The box 12 includes a front wall 14, a rear wall 16, side walls (not shown), and a bottom wall 24. The front wall 14, rear wall 16, side walls, and the bottom wall 24 define a four sided cavity 25. Preferably the front, rear, and side walls would be formed from stained wood, for example stained poplar. Extending upwardly from the bottom wall 24 as vertical projections are a front cross 18 and a pair of rear crosses 20. Preferably the front cross 18 will be generally centered laterally on the bottom wall 24 and the rear crosses 20 will be offset on each side of the front cross 18. The crosses 18 and 20 may be mounted to the bottom wall 24 by a screw. Sand 22 may be retained within the cavity 25. Small stones 26 of various size, texture, and color may be placed in the sand 22. A light holder 30 containing a light 28, for example and LED light, is mounted near the top of the front wall 14. The light 28 is laterally centered on the front wall 14 and angled upward at about 45° such that the rays of light from the light 28 shine on the crosses 18 and 20. A battery holder 32 may be mounted to the bottom wall 24 and/or rear wall 16 to retain batteries that provide power for the light 28. In operation, the shadow projecting device 10 is placed at a distance from a wall 34 that serves to provide a background service. When the light 28 is illuminated the light rays shining directly on the crosses 18 and 20 illuminate the crosses. Additionally, the light will shine on the background wall 34 and form shadows in the shape of the crosses 18 and 20. The size of the shadows on the wall 34 will vary according to the distance of the shadow projecting device 10 from the wall 34.

Figure 2A:
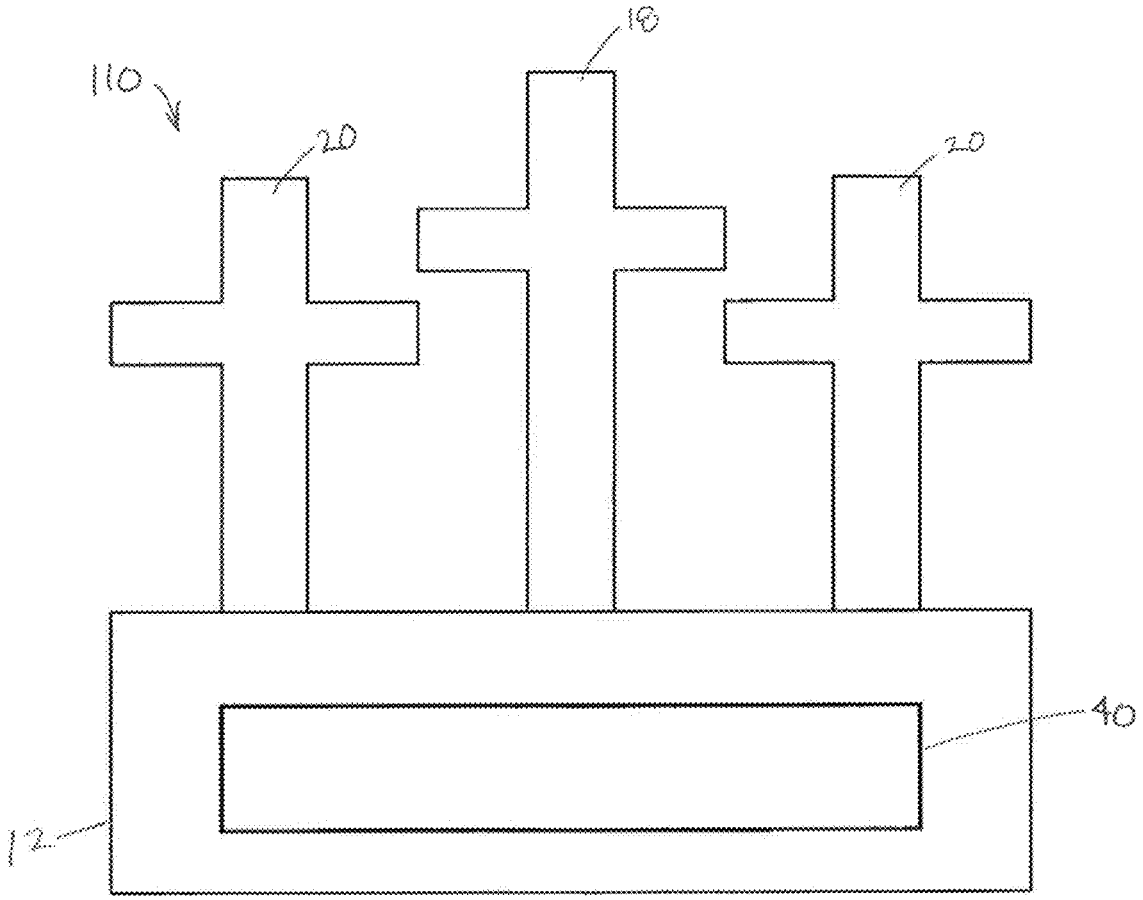
FIG. 2A is a front elevation view of a shadow projecting device that includes a book shelf.
Figure 2B:
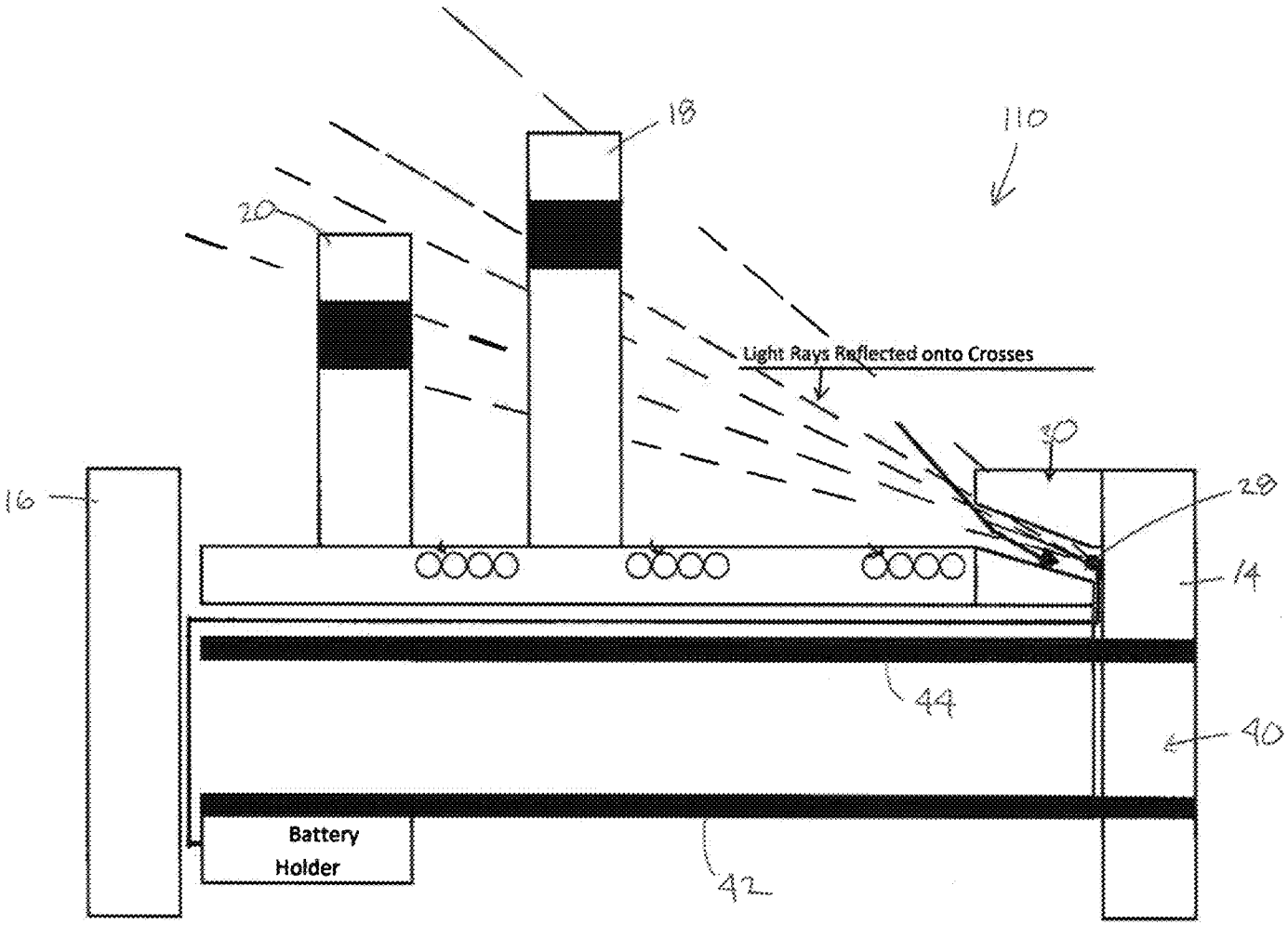
FIG. 2B is a cross sectional side elevation view of the shadow projecting device with book shelf of FIG. 2A.

FIGS. 2A and 2B show a shadow projecting device 110 according to another embodiment of the present invention. The shadow projecting device 110 of FIGS. 2A and B is similar to the shadow projecting device 10 of FIGS. 1A and B except that the box 12 includes an open slot 40 through the front wall 14. The opening 40 allows a book, such as a Bible, to be inserted into the box 12 where it will be retained between a bottom shelf 42 and a top shelf 44.

Figure 3A:
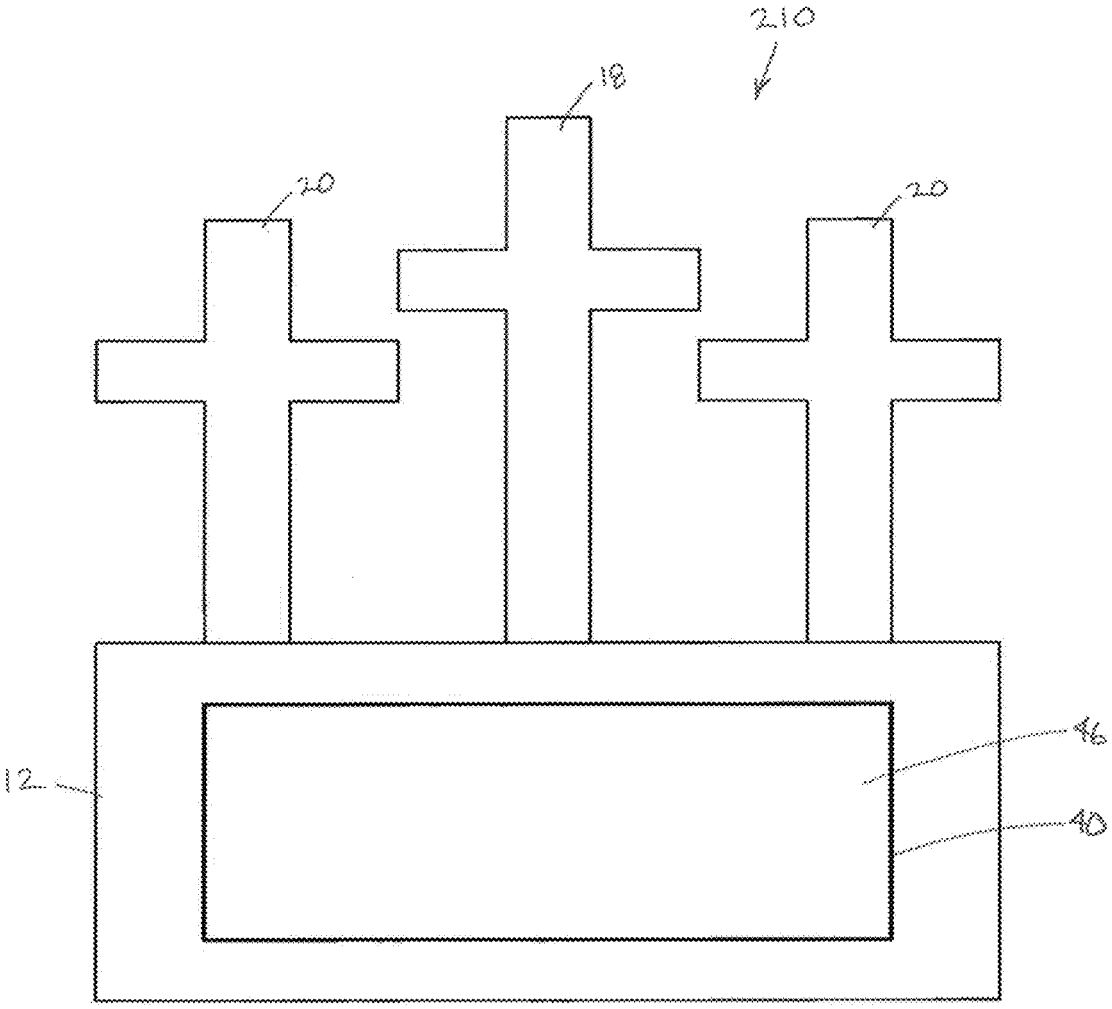
FIG. 3A is a front elevation view of a shadow projecting device according to one embodiment of the present invention including a drawer.
Figure 3B:
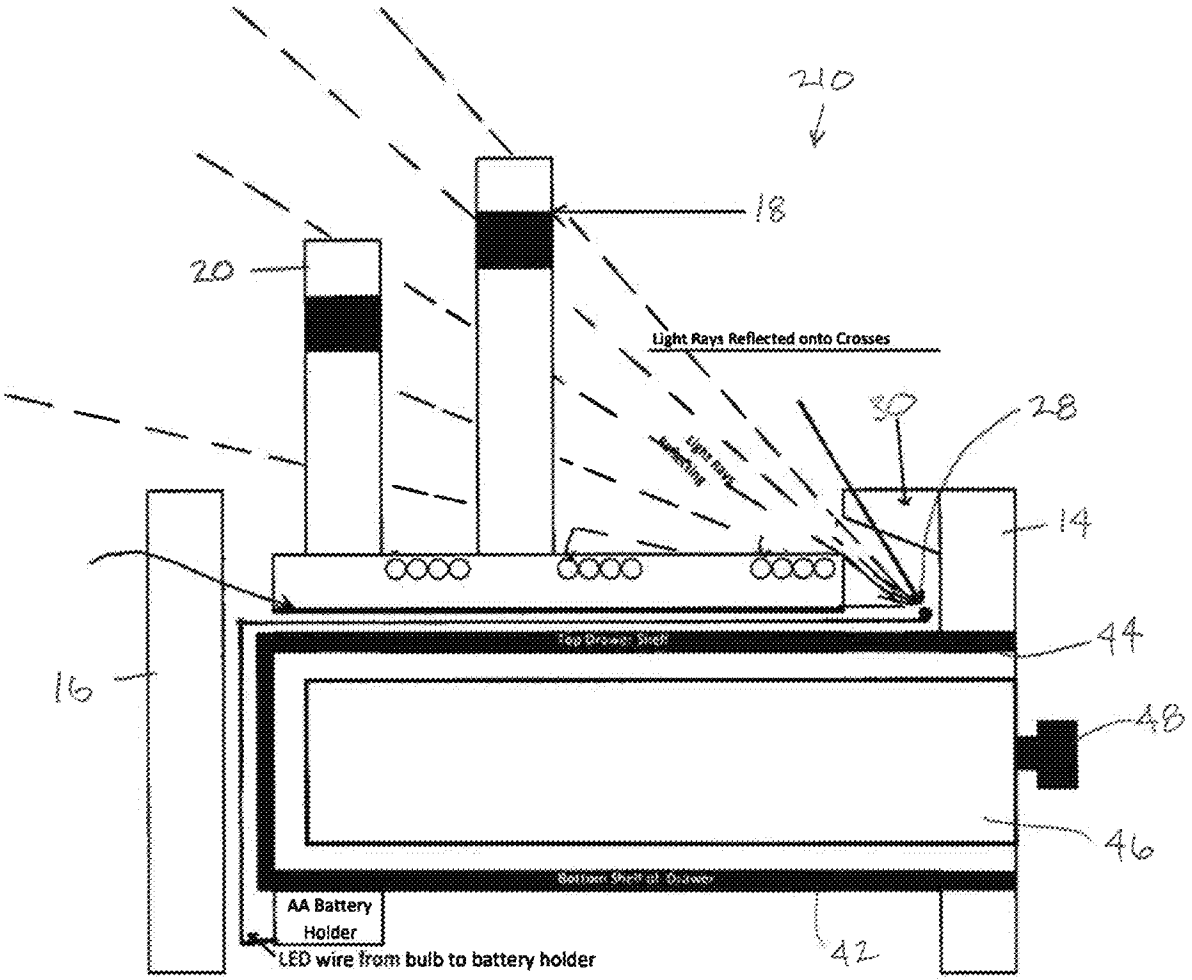
FIG. 3B is a cross sectional side elevation view of the shadow projecting device with drawer of FIG. 3A.

FIGS. 3A and 3B show a shadow projecting device 210 that is similar to the shadow projecting device 110, except that it also includes a drawer 46 within the slot 40. The drawer 46 may include a knob 48 to be used in withdrawing and returning the drawer 46 from the box 12 through the slot 40.

Figure 4A:
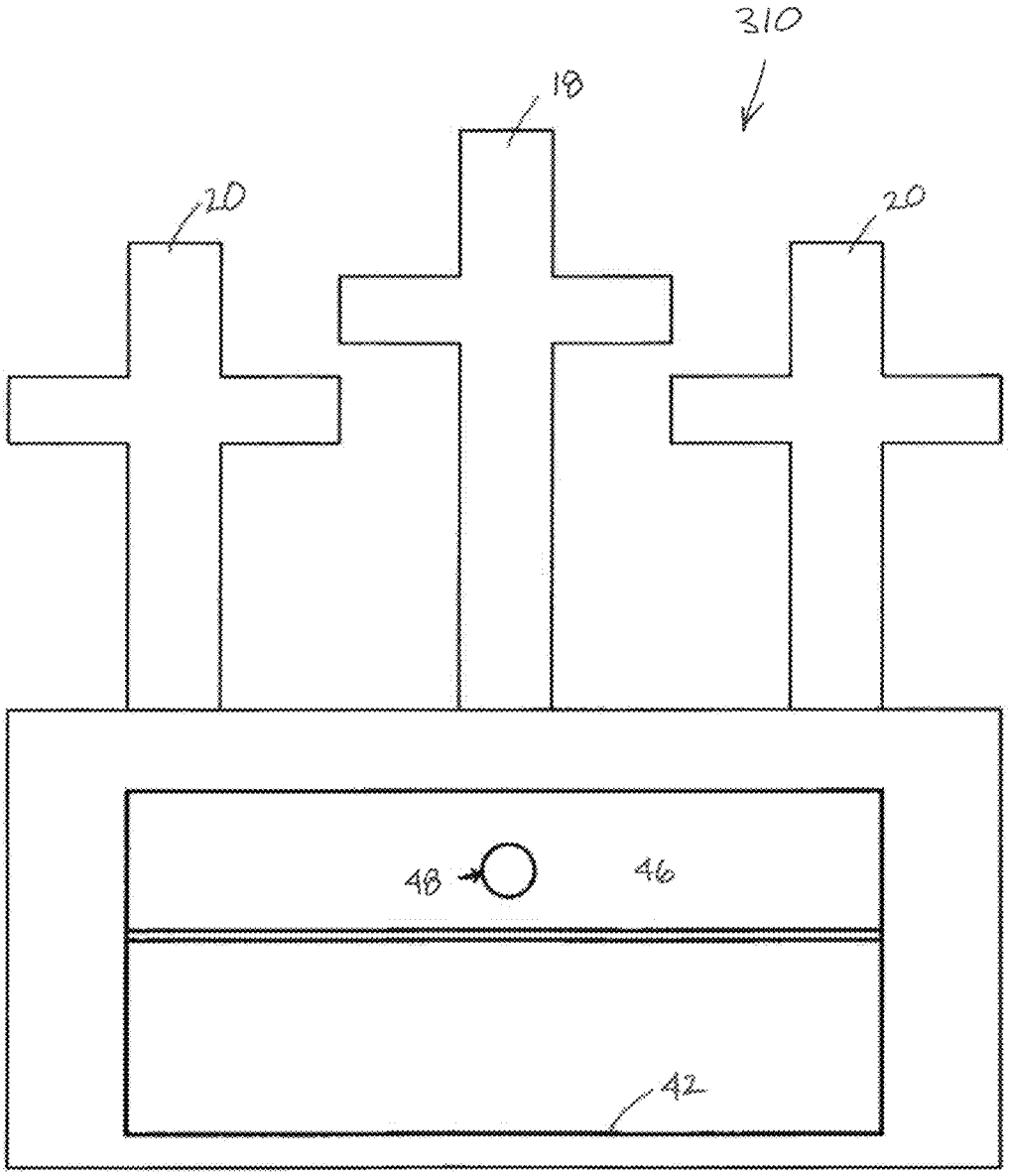
FIG. 4A is a front elevation view of a shadow projecting device according to one embodiment of the present invention including a drawer and a book shelf.
Figure 4B:
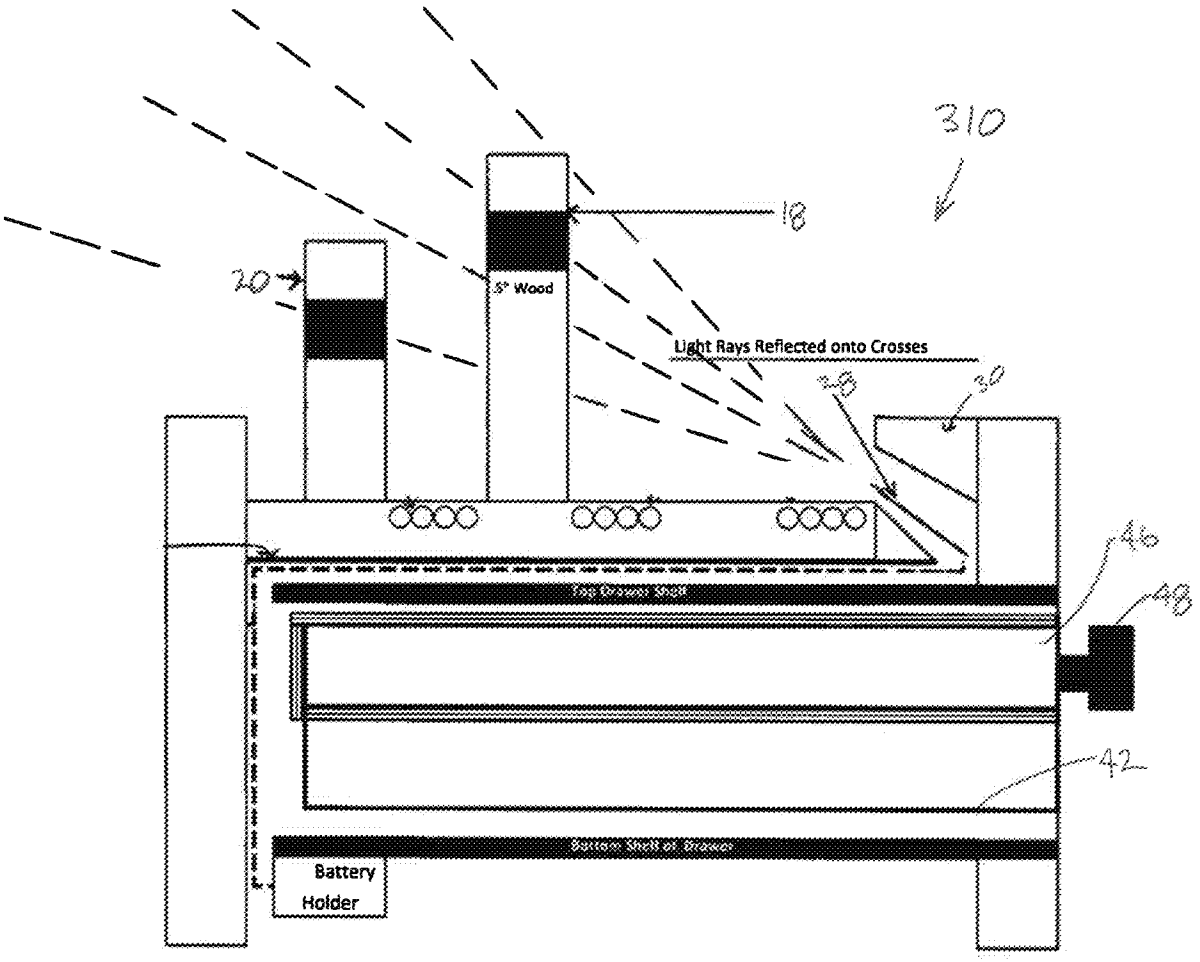
FIG. 4B is a cross sectional side elevation view of the shadow projecting device with drawer and book shelf of FIG. 4A.

FIGS. 4A and 4B show a shadow projecting device 310 that is similar to the shadow projecting device 210, except that the drawer 46 only occupies a top portion of the opening 40, such that a Bible, or other book may be supported on the bottom shelf 42 beneath the drawer 46.

What is claimed is:

1. A shadow projecting device comprising:

a box, the box having a cavity defined by a front wall, a rear wall, side walls, and a bottom wall so as to define a box width and depth;

sand retained within the cavity;

a first cross fixed to and extending upward from the bottom wall through the sand to a height above the rear wall;

the cross having a width and depth smaller than the box width and depth such that the cross width and depth are contained within the front, rear, and side walk of the box; and a light source associated with the front wall at a position spaced forwardly from the first cross, the light source shining light generally upward and rearward towards the first cross to illuminate the first cross and to form a cross shadow on a background surface.

2. The shadow projecting device of claim 1, further comprising second and third crosses fixed to and extending upward from the bottom wall through the sand.

3. The shadow producing device of claim 2, wherein the second and third crosses are shorter than the first cross.

4. The shadow producing device of claim 1, further comprising a shelf underneath the bottom wall and wherein the front wall has an opening to permit a Bible to be inserted through the front wall on to the shelf.

5. The shadow producing device of claim 1, further comprising a drawer below the bottom wall.

6. The shadow producing device of claim 5, further comprising a shelf underneath the drawer and wherein the front wall has an opening to permit a Bible to be inserted through the front wall on to the shelf.

7. The shadow producing device of claim 1 wherein the light is beneath a holder mounted on the front wall of the box.

8. The shadow producing device of claim 1 further comprising a light holder mounted to the front wall adjacent a top edge of the front wall for operatively supporting the light.

9. The shadow producing device of claim 1 wherein the first cross has a height, and the light is spaced from the first cross a distance greater than the height.

10. The shadow producing device of claim 1 wherein the first cross has a height and is spaced from the front wall a distance greater than the height.

11. The shadow producing device of claim 1 wherein an angle from the light to a top of the first cross is about 45° from horizontal.

12. The shadow producing device of claim 1 wherein an angle from the light to a top of the first cross is less than 45° above horizontal.

* * * * *